US008529194B2

(12) United States Patent
Ammann et al.

(10) Patent No.: US 8,529,194 B2
(45) Date of Patent: Sep. 10, 2013

(54) SHANK CAVITY AND COOLING HOLE

(75) Inventors: Luke John Ammann, Simpsonville, SC (US); Camilo Andres Sampayo, Greer, SC (US)

(73) Assignee: General Electric Company, Schenectady, NY (US)

( * ) Notice: Subject to any disclaimer, the term of this patent is extended or adjusted under 35 U.S.C. 154(b) by 849 days.

(21) Appl. No.: 12/783,028

(22) Filed: May 19, 2010

(65) Prior Publication Data

US 2012/0070305 A1 Mar. 22, 2012

(51) Int. Cl.
*F01D 5/18* (2006.01)

(52) U.S. Cl.
USPC ..... 415/115; 416/97 R

(58) Field of Classification Search
USPC ..... 415/115, 116; 416/96 A
See application file for complete search history.

(56) References Cited

U.S. PATENT DOCUMENTS

| | | | | |
|---|---|---|---|---|
| 5,609,466 | A * | 3/1997 | North et al. | 415/115 |
| 5,639,216 | A | 6/1997 | McLaurin et al. | |
| 6,176,678 | B1 * | 1/2001 | Brainch et al. | 416/97 R |
| 6,945,749 | B2 | 9/2005 | De Cardenas | |
| 7,775,769 | B1 * | 8/2010 | Liang | 416/97 R |
| 2005/0100437 | A1 * | 5/2005 | Phillips et al. | 415/115 |
| 2010/0054954 | A1 * | 3/2010 | Itzel et al. | 416/97 R |

* cited by examiner

*Primary Examiner* — Nathaniel Wiehe
*Assistant Examiner* — Jeffrey A Brownson
(74) *Attorney, Agent, or Firm* — Cantor Colburn LLP

(57) ABSTRACT

A turbine bucket is provided and includes a shank defining a cavity therein, which is connectable with a rotor such that wheelspace air having an initial pressure is permitted to flow into the cavity and a platform coupled to the shank and defining a cooling hole therein, the shank and the platform each further defining the cavity and the cooling hole, respectively, as being fluidly communicative with one another, such that the wheelspace air permitted to flow into the cavity is deliverable from the cavity and through the cooling hole at a second pressure greater than the initial pressure.

12 Claims, 2 Drawing Sheets

SHANK CAVITY AND COOLING HOLE

BACKGROUND OF THE INVENTION

The subject matter disclosed herein relates to a turbine bucket with a shank cavity and a cooling hole.

In turbine engines, such as gas or steam turbine engines, a mixture of fuel and air are combusted within a combustor and the by products of that combustion are delivered to a turbine section downstream as high temperature fluids. These high temperature fluids aerodynamically interact with annular arrays of turbine blades at various stages and thereby produce power and/or electricity.

In some cases, the high temperature fluids may cause damage to the turbine blades by, for example, thermal degradation. As a result, it may be necessary to cool the turbine blades as a countermeasure. Unfortunately, providing coolant to the turbine blades can be operationally costly and may often require relatively complex fluid circuitry that is difficult to install and maintain.

BRIEF DESCRIPTION OF THE INVENTION

According to one aspect of the invention, a turbine bucket is provided and includes a shank defining a cavity therein, which is connectable with a rotor such that wheelspace air having an initial pressure is permitted to flow into the cavity and a platform coupled to the shank and defining a cooling hole therein, the shank and the platform each further defining the cavity and the cooling hole, respectively, such that the cavity and the cooling hole are fluidly communicative and such that the wheelspace air, which is permitted to flow into the cavity, is deliverable from the cavity to the cooling hole, and through the cooling hole at a second pressure, which is greater than the initial pressure.

According to another aspect of the invention, a turbine bucket is provided and includes a shank including a shank body defining a cavity therein, the shank body being connectable with a rotor such that wheelspace air having an initial pressure is permitted to flow into the cavity, a platform including a platform body coupled to the shank and defining a cooling hole therein, which is fluidly communicative with the cavity such that the wheelspace air, which is permitted to flow into the cavity, is deliverable from the cavity to the cooling hole and through the cooling hole at a second pressure greater than the initial pressure and an aft platform extending from the platform at which the cooling hole terminates such that the wheelspace air is exhaustible into at least one of a turbine flow path, which is defined substantially radially outwardly from the aft platform, and a trench cavity, which is defined substantially radially inwardly from the aft platform.

According to yet another aspect of the invention, a turbine bucket is provided and includes a shank defining a cavity therein, which is connectable with a rotor such that wheelspace air having an initial pressure is permitted to flow into the cavity, a platform coupled to the shank and defining a main cooling hole therein, which is fluidly communicative with the cavity, and tributary cooling holes therein, which are fluidly communicative with the main cooling hole, such that the wheelspace air, which is permitted to flow into the cavity, is deliverable from the cavity to the main cooling hole, through the main cooling hole and subsequently through the tributary cooling holes at a second pressure greater than the initial pressure and an aft platform extending from the platform at which the tributary cooling holes terminate such that the wheelspace air is exhaustible into at least one of a turbine flow path, which is defined substantially radially outwardly from the aft platform, and a trench cavity, which is defined substantially radially inwardly from the aft platform.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
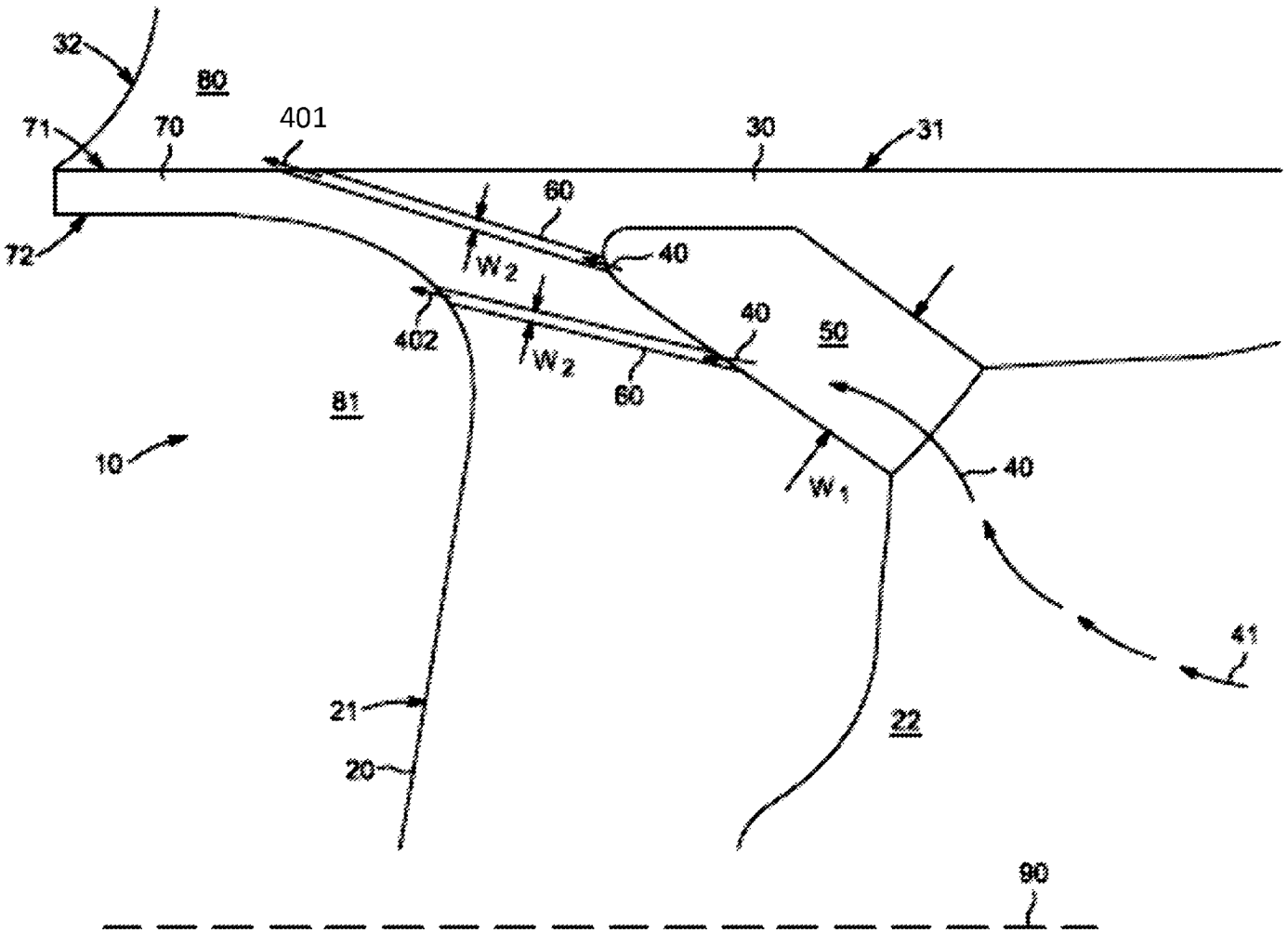
FIG. 1 is an enlarged side sectional view of a portion of a turbine bucket.
Figure 2:
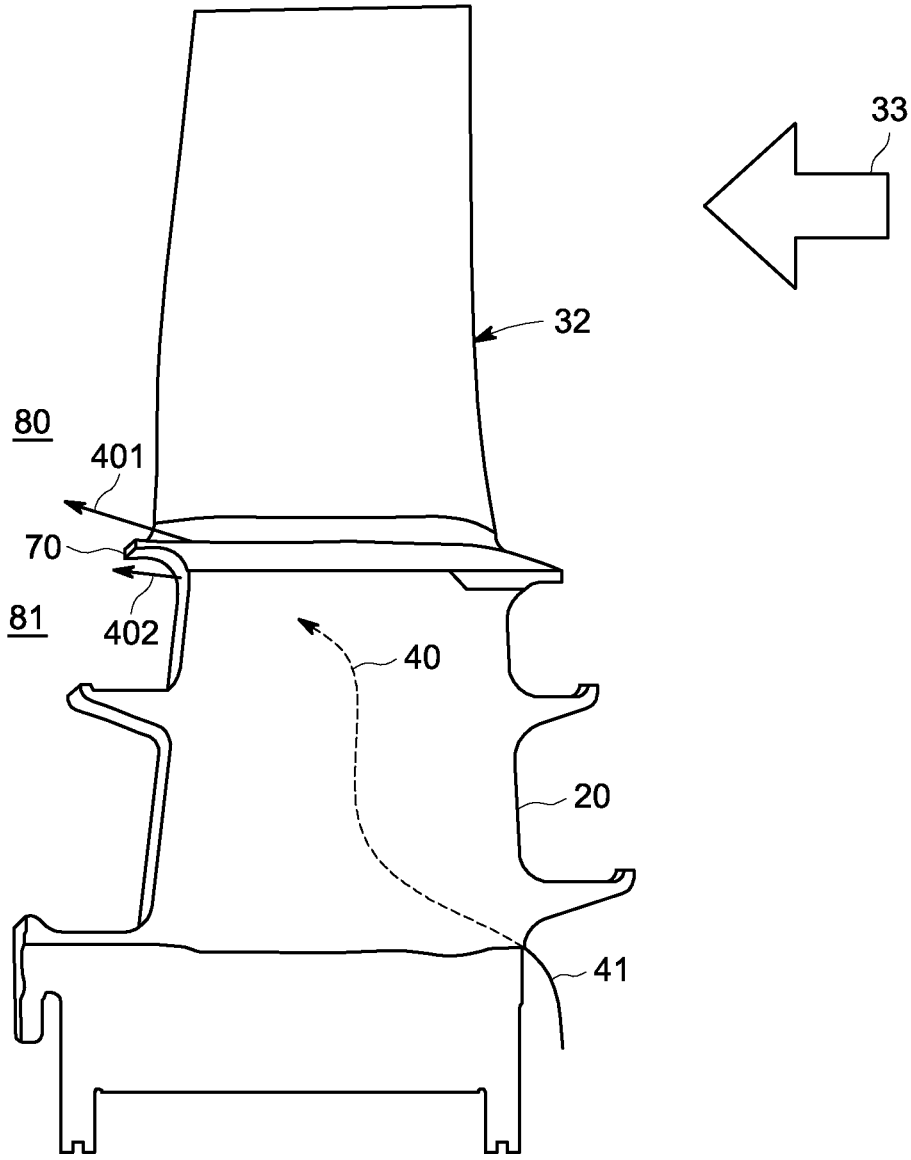
FIG. 2 is a side view of the turbine bucket of FIG. 1.

With reference to FIGS. 1 and 2, a turbine bucket 10 is provided and includes a shank 20, including a shank body 21, a platform 30, including a platform body 31, and an aft platform 70. The shank body 21 is formed to define a shank cavity 22 therein and has, in some embodiments, a radially inward section that is connectable with a dovetail assembly of a rotor. This connection permits wheelspace air 40 having an initial pressure to flow or leak into the shank cavity 22.

The platform body 31 supports an airfoil 32 over which hot fluids and gases 33 flow and is integrally coupled to a radially outward portion of the shank body 21 and is formed to define a cooling hole with an inlet and a mid-section therein. The inlet is a main cooling hole 50 and the mid-section may include one or more tributary cooling holes 60. Both the main cooling hole 50 and the tributary cooling holes 60 may be oriented at an oblique angel relative to a centerline 90 of the rotor. The main cooling hole 50 is fluidly communicative with the shank cavity 22 and the tributary cooling holes 60 are fluidly communicative with the main cooling hole 50. As such, the wheelspace air 40 that is permitted to flow into the shank cavity 22 is deliverable from the shank cavity 22, through the main cooling hole 50 and through the tributary cooling holes 60 at a second pressure that may be at least similar to or, in some cases, greater than the initial pressure.

The aft platform 70 extends axially from the main platform body 31 and includes a flow path facing surface 71 and a trench cavity facing surface 72. The tributary cooling holes 60 may each terminate at the aft platform 70. More particularly, a first group of the tributary cooling holes 60 may terminate at the flow path facing surface 71 and a second group of the tributary cooling holes 60 may terminate at the trench cavity facing surface 72. In some embodiments, the first group of tributary cooling holes 60 may be circumferentially aligned with one another. Similarly, the second group of tributary cooling holes 60 may be circumferentially aligned with one another.

Where the tributary cooling holes 60 terminate at the flow path facing surface 71, the wheelspace air 40 may flow over a portion of the flow path facing surface 71 and be exhaustible as first exhaust 401 into the turbine flow path 80, which is defined substantially radially outwardly of the aft platform 70. Conversely, where the tributary cooling holes 60 terminate at the trench cavity facing surface 72, the wheelspace air 40 may impinge upon the trench cavity facing surface 72 and be exhaustible as second exhaust 402 into the trench cavity 81, which is defined substantially radially inwardly of the aft platform 70.

The wheelspace air 40 removes heat from the turbine bucket 10 at a variety of locations and in a variety of ways. For example, the wheelspace air 40 in the shank cavity 22, the main cooling hole 50 and the tributary cooling holes 60 provide convective cooling while those portions of the shank body 21 and the platform body 31 proximate to the shank cavity 22, the main cooling hole 50 and the tributary cooling holes 60 thereby experience conductive cooling. Similarly, the wheelspace air 40 that is output from the tributary cooling holes 60 into the turbine flow path 80 may flow over the flow path facing surface 71 to thereby provide film cooling to the flow path facing surface 71. The wheelspace air 40 that is output from the tributary cooling holes 60 into the trench cavity 81 may impinge upon the trench cavity facing surface 72 to thereby provide impingement cooling to the trench cavity facing surface 72.

The main cooling hole 50 has a width, W1, which is wider that the width, W2, of the tributary cooling holes 60. As such, a pressure of the wheelspace air 40 flowing into the tributary cooling holes 60 may be maintained or increased from the initial pressure. In some embodiments, the pressure of the wheelspace air 40 may be further increased by an inflow of additional wheelspace air 41 and centrifugal force applied thereto during rotation of the turbine bucket 10 about the rotor.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine bucket, comprising:

a shank defining a cavity therein, which is connectable with a rotor such that wheelspace air having an initial pressure is permitted to flow into the cavity; and a platform coupled to the shank and defining a cooling hole therein, the platform comprising an aft platform at which the cooling hole terminates, wherein the aft platform separates a flow path from a trench cavity and defines a flow path facing surface and a trench cavity facing surface, the cooling hole comprising a plurality of cooling holes, a first group of the plurality of cooling holes being aligned with one another and terminating at the flow path facing surface and a second group of the plurality of cooling holes being aligned with one another and terminating at the trench cavity facing surface, and the shank and the platform each further defining the cavity and the cooling hole, respectively, such that the cavity and the cooling hole are fluidly communicative and such that the wheelspace air, which is permitted to flow into the cavity, is deliverable:

from the cavity to the cooling hole, and through the cooling hole at a second pressure, which is greater than the initial pressure.

2. The turbine bucket according to claim 1, wherein an inlet of the cooling hole has a width that is equal to or wider than that of a mid-section thereof.

3. The turbine bucket according to claim 1, wherein the cooling hole is oriented at an oblique angle with respect to a centerline of the rotor.

4. The turbine bucket according to claim 1, wherein the wheelspace air is pressurized by at least one of an inflow of additional wheelspace air and centrifugal force applied thereto.

5. The turbine bucket according to claim 1, wherein the wheelspace air removes heat from at least the platform by one or more of impingement cooling, convective cooling, conductive cooling and film cooling.

6. A turbine bucket, comprising:

a shank including a shank body defining a cavity therein, the shank body being connectable with a rotor such that wheelspace air having an initial pressure is permitted to flow into the cavity;

a platform including a platform body coupled to the shank and defining a cooling hole therein, which is fluidly communicative with the cavity such that the wheelspace air, which is permitted to flow into the cavity, is deliverable from the cavity to the cooling hole and through the cooling hole at a second pressure greater than the initial pressure; and an aft platform extending from the platform at which the cooling hole terminates such that the wheelspace air is exhaustible into at least one of a turbine flow path, which is defined substantially radially outwardly from the aft platform, and a trench cavity, which is defined substantially radially inwardly from the aft platform, wherein the aft platform separates the turbine flow path from the trench cavity and defines a turbine flow path facing surface and a trench cavity facing surface, and the cooling hole comprises a plurality of cooling holes, a first group of the plurality of cooling holes being aligned with one another and terminating at the turbine flow path facing surface and a second group of the plurality of cooling holes being aligned with one another and terminating at the trench cavity facing surface.

7. The turbine bucket according to claim 6, wherein the wheelspace air removes heat from at least the platform by one or more of impingement cooling, convective cooling, conductive cooling and film cooling.

8. A turbine bucket, comprising:

a shank defining a cavity therein, which is connectable with a rotor such that wheelspace air having an initial pressure is permitted to flow into the cavity;

a platform coupled to the shank and defining a main cooling hole therein, which is fluidly communicative with the cavity, and tributary cooling holes therein, which are fluidly communicative with the main cooling hole, such that the wheelspace air, which is permitted to flow into the cavity, is deliverable from the cavity to the main cooling hole, through the main cooling hole and subsequently through the tributary cooling holes at a second pressure greater than the initial pressure; and an aft platform extending from the platform at which the tributary cooling holes terminate such that the wheelspace air is exhaustible into at least one of a turbine flow path, which is defined substantially radially outwardly from the aft platform, and a trench cavity, which is defined substantially radially inwardly from the aft platform, wherein the aft platform separates the turbine flow path from the trench cavity and defines a turbine flow path facing surface and a trench cavity facing surface, and the tributary cooling holes comprise a first group of tributary cooling holes being aligned with one another and terminating at the turbine flow path facing surface and a second group of tributary cooling holes being aligned with one another and terminating at the trench cavity facing surface.

9. The turbine bucket according to claim 8, wherein the main cooling hole has a width that is equal to or wider than that of each of the tributary cooling holes.

10. The turbine bucket according to claim 8, wherein the main and the tributary cooling holes are each oriented at an oblique angle with respect to a centerline of the rotor.

11. The turbine bucket according to claim 8, wherein the wheelspace air is pressurized by at least one of an inflow of additional wheelspace air and centrifugal force applied thereto.

12. The turbine bucket according to claim 8, wherein the wheelspace air removes heat from at least the platform by one or more of impingement cooling, convective cooling, conductive cooling and film cooling.

* * * * *